United States Patent [19]

Allen et al.

[11] Patent Number: 4,723,931

[45] Date of Patent: Feb. 9, 1988

[54] TOY ACTION FIGURE WITH ACCESSORY-ATTACHING CAPABILITY

[75] Inventors: Robert K. Allen, Cincinnati, Ohio; Philip M. Baerenwald, Florence, Ky.; Mark D. Boudreaux; Timothy A. Effler, both of Cincinnati, Ohio; Phillip G. Reed, Loveland, Ohio; Stuart A. Cook, East Greenwich, R.I.

[73] Assignee: Kenner Parker Toys Inc., Beverly, Mass.

[21] Appl. No.: 826,410

[22] Filed: Feb. 5, 1986

[51] Int. Cl.[4] ..... A63H 3/00; A63H 3/16; A63H 3/28

[52] U.S. Cl. ..... 446/268; 446/97; 446/297; 446/359

[58] Field of Search ..... 446/97, 99, 101, 94, 446/95, 376, 378, 352, 358, 359, 128, 121, 420, 268, 90, 291, 290, 297; 403/298

[56] References Cited

U.S. PATENT DOCUMENTS

| | | | |
|---|---|---|---|
| 2,196,679 | 4/1940 | Krakowski | 446/420 |
| 2,751,709 | 6/1956 | Barrango | 446/378 |
| 3,128,575 | 4/1964 | Stanetzki | 446/291 X |
| 3,674,068 | 7/1972 | Lucci | 403/298 X |
| 3,883,258 | 5/1975 | Hewson | 403/298 |
| 3,961,440 | 6/1976 | Saito | 446/94 X |
| 4,051,623 | 10/1977 | Ogawa | 446/290 |
| 4,159,592 | 7/1979 | Gabriel | 446/121 |
| 4,170,840 | 10/1979 | Ogawa | 446/97 X |
| 4,186,515 | 2/1980 | Ogawa | 446/99 |
| 4,361,980 | 12/1982 | Chatani | 446/121 X |
| 4,450,650 | 5/1984 | Holden et al. | 446/94 |
| 4,582,447 | 4/1986 | Itoh | 446/128 X |

*Primary Examiner*—Mickey Yu

*Attorney, Agent, or Firm*—L. MeRoy Lillehaugen; Gene O. Enockson; Stuart R. Peterson

[57] ABSTRACT

Various patterns of receptor holes formed in the torso, arms and legs of a plastic toy action figure permit various accessories, also of plastic, having compliant press-in pins to be selectively added to and removed from the toy figure. Additionally, a rotatable coupling mechanism extends through the torso, the coupling mechanism having a receptor hole at each end thereof, the holes in the coupling mechanism being in a predetermined relation with respect to prearranged patterns of receptor holes in the front and rear of the torso. In this way, accessories can be plugged into the ends of the coupling mechanism. The coupling mechanism is provided with two sets of facial teeth or serrations that are normally resiliently urged into engagement but which disengage if the coupling mechanism is subjected to an excessive amount of twisting force, thereby avoiding breakage. Associated with the coupling mechanism is a sound creating device that produces an audible clicking as the coupling mechanism is rotated in either direction.

13 Claims, 15 Drawing Figures

112
10
18
134d
12
14
82b
90
51
88
86
84
134b
20
134c
22
16
106
108
110
82a
132b
132c
98
104
102
82
96
100
80
92

TOY ACTION FIGURE WITH ACCESSORY-ATTACHING CAPABILITY

FIELD OF THE INVENTION

This invention relates generally to toy action figures, and pertains more particularly to such a figure to which various accessories can be releasably attached.

SUMMARY OF THE INVENTION

A general object of the invention is to provide a toy action figure having a futuristic appearance to which various accessories can be added so that the child can create its own combinations and which allows the child to originate various battle modes through the agency of accessories simulating a variety of weapons and propulsion devices. In this way, the child can use its imagination in deriving various space age mission systems and effectuating fanciful air, sea and land battle strategies. Thus, it is within the purview of the invention to provide a toy action figure having an intriguing and unique overall appearance that will prove exciting to children of various ages.

A more specific object of the invention is to provide a toy action figure in which its accessory-attaching capability is realized through the agency of specially configured press-in pins that are mounted on the various accessories to be releasably attached to the more basic toy action figure. The toy action figure is provided with a number of receptor holes in which the pins can be inserted to effect the releasable attachment of the particular accessory. In this regard, an aim of the invention is to provide a toy action figure that will make use of press-in pins associated with the various accessories to be attached, each pin being sufficiently compliant so that it can be pushed straight into any of a number of receptor holes and also pulled straight out of such holes, both directional movements being manually achievable without exceeding acceptable force limits. Because but little dexterity is required, even relatively small children are able to attach and detach various accessories, either to create a specific combination of parts envisaged by the child or to simply create a composite combination of parts having no meaning other than that the child derives a degree of satisfaction and accomplishment from merely interconnecting one or more items with one or more other items.

Yet another object of the invention is to give the child a choice as to the type of add-on accessory he or she wishes to combine with the more basic toy action figure. In this regard, in one instance the child may snap onto the figure a particular accessory that is to be rotated via a coupling mechanism extending forwardly through the figure's torso, or on the other hand the child can elect to add an accessory that remains stationary once it has been attached to the toy figure. More specifically, it is within the scope of the invention to provide various receptor holes which permit either an animated result, a static result or both to be achieved, thereby imparting a considerable amount of versatility to a toy figure constructed in accordance with the present invention.

Still further, an object of the invention is to provide a coupling mechanism within the torso of the toy figure that has included therein an overload feature so that excessive manual twisting or torsional forces used to effect an animated result cannot be applied to the figure in such a way and with such magnitude as to break some of the components. In this regard, a mechanism for transmitting rotary movement through the figure's torso is provided with interfitting face-to-face sawteeth or serrations that are normally urged into engagement by a resilient coil spring and which teeth or serrations will automatically disengage, the coil spring permitting this, when too much twisting force is employed.

Another object is to provide a basic toy figure that will be rugged and long lasting, yet possessing a sufficient amount of variety and animation capability so that it will maintain the interest of the child over a considerable period of time.

The invention also has for an object the mass producing of toy figures in accordance with the invention which toy figures can be fabricated and sold at a comparatively low price, thereby encouraging the widespread purchase and use of figures of this type, the relatively low manufacturing costs per item allowing a rather large assortment of various accessories to be made available that can be snapped into position in conjunction with certain basic action figures.

It is also within the contemplation of the invention to provide a toy action figure of composite design in which one half can be attached to another half via compliant pins so that unusual toy configurations can be created by the child. For instance, one portion of the composite toy figure can represent a human being and the other half, say, a machine.

Briefly, the invention envisions relatively small three-dimensional toy action figures having a number of receptor holes formed therein which are arranged in predetermined patterns so that various accessories can be readily attached and detached. In this regard, each receptor hole is formed with a bore having a recessed annular internal rib located inwardly from the entrance of the bore so that a specially configured press-in or mating pin, the pin having a circumferential groove and a compliance slot, can be pressed into a selected receptor hole so that the resulting snap fit will retain the particular accessory in place until deliberately removed by the child.

It is planned that receptor holes in the ends of a coupling mechanism be physically oriented in a predetermined relationship with respect to the receptor holes in the toy figure's torso. In this way, the child is afforded the opportunity of selecting accessories to be attached to the coupling mechanism so that one accessory can be used to drivingly rotate the coupling mechanism and a second accessory be drivenly rotated by the coupling mechanism, the particular receptor hole patterns in the torso itself which are located in the vicinity of the receptor holes provided in the coupling ends enabling even relatively large accessories to be attached. The transmitted rotation through the agency of the coupling mechanism can be converted into other motions.

By means of interengaging facial teeth within the coupling mechanism and a coil spring yieldingly acting against one set of such teeth, the teeth will automatically disengage when an excessive twisting force is applied so that the parts associated with transmitting the motion will not become broken or damaged.

Thus, the child can add to a rather basic toy action figure a number of accessories, some of which can be of an animated character and others of which will simply be attached to the figure without any relative movement.

DESCRIPTION OF THE PREFERRED EMBODIMENTS

Figure 1:
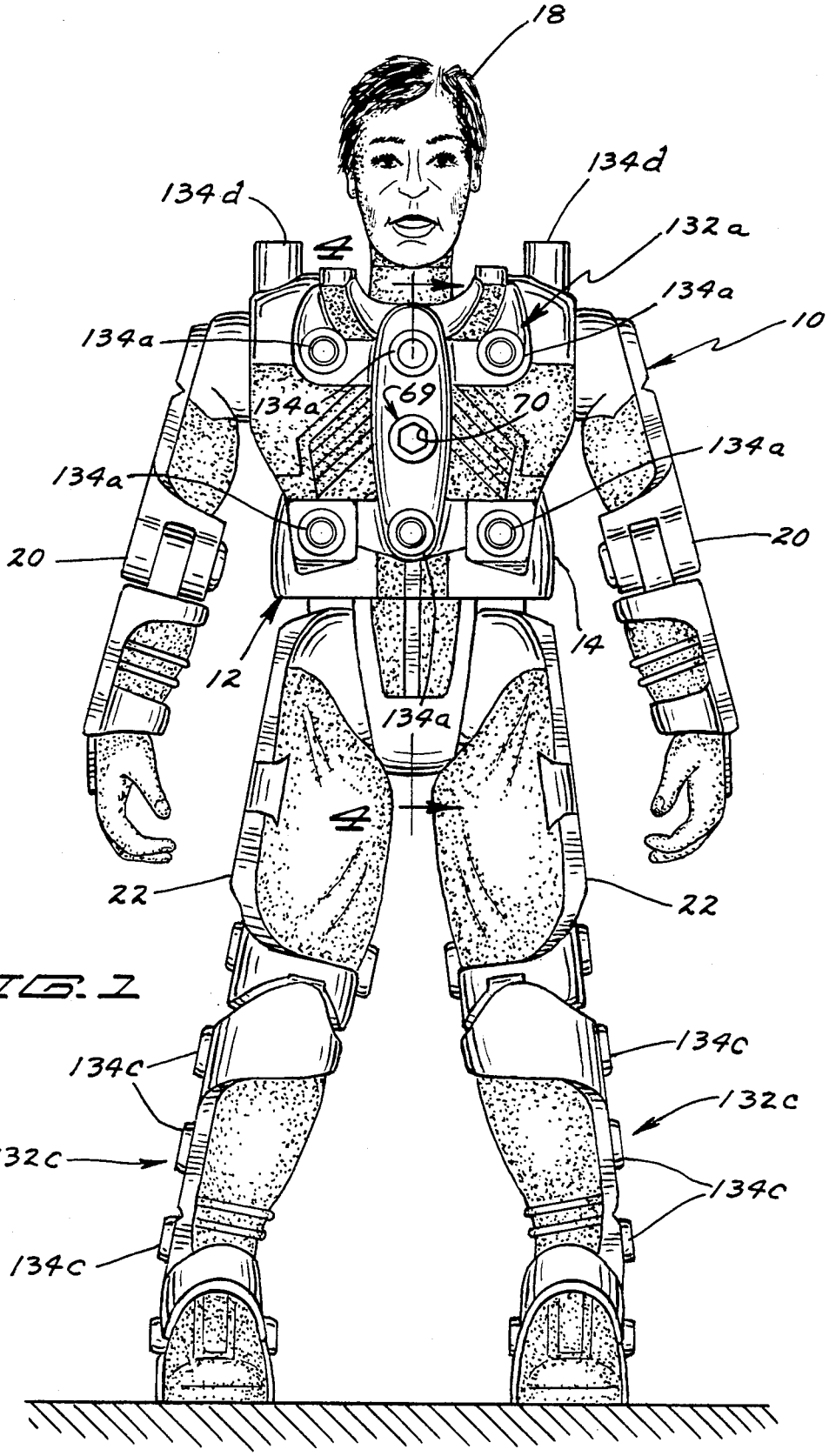
FIG. 1 is a front elevational view of a toy action figure without any accessories having been attached thereto.
Figure 3:
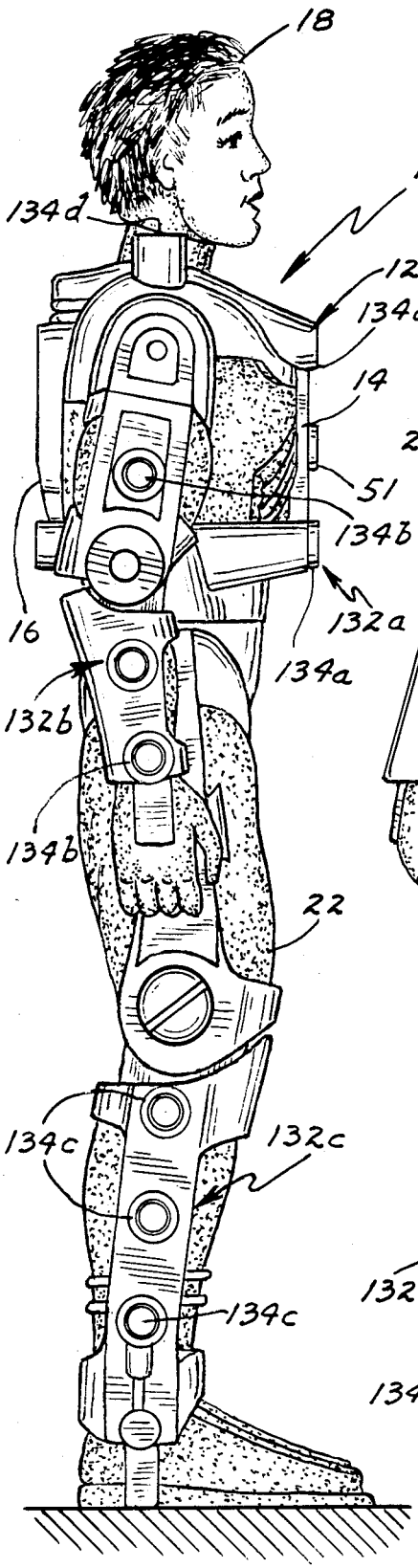
FIG. 3 is a side elevational view taken from the right of FIG. 1.
Figure 2:
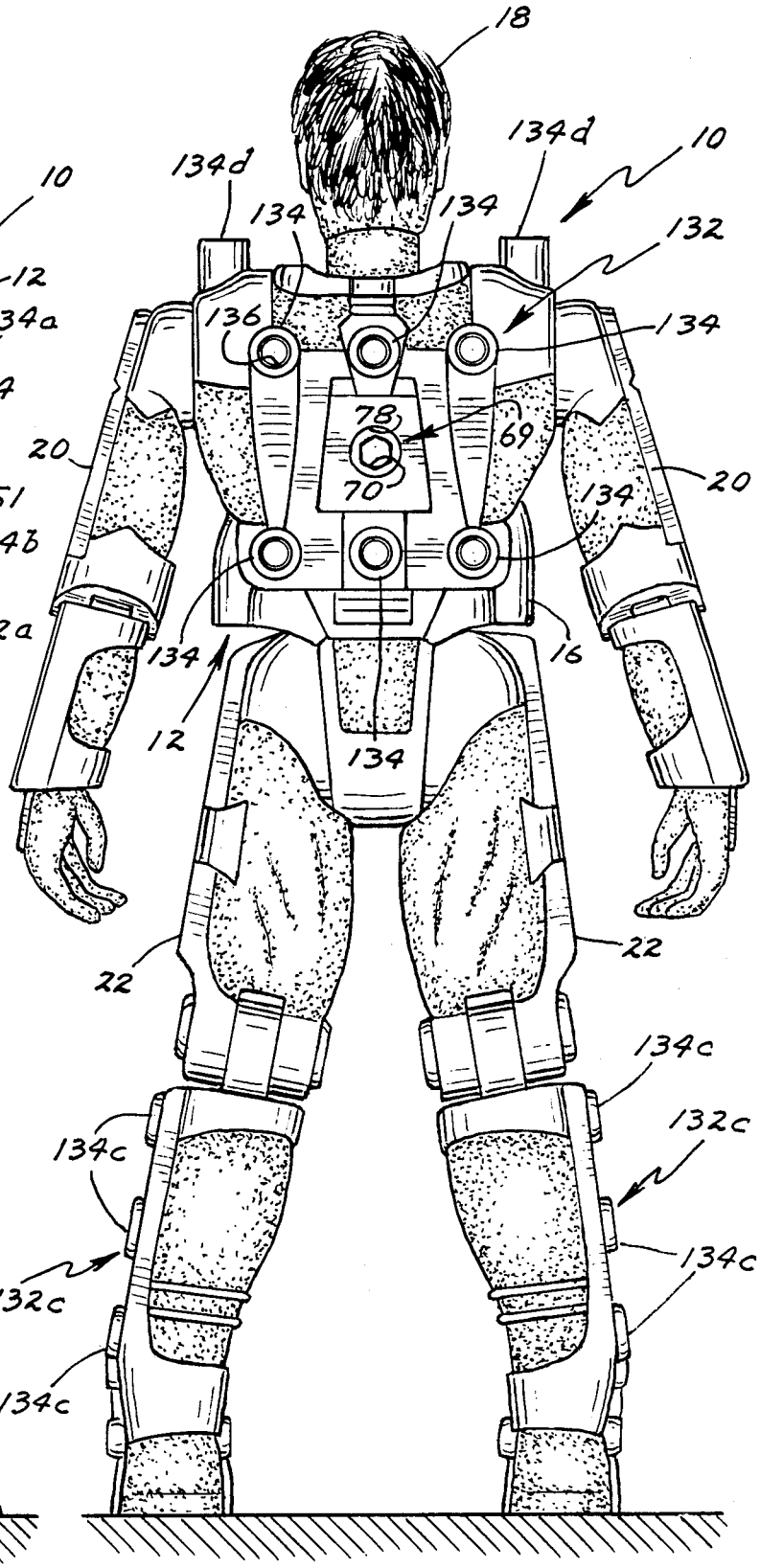
FIG. 2 is a rear elevational view of the toy figure appearing in FIG. 1, this view also being without accessories.

Referring to FIGS. 1, 2 and 3, a toy action figure exemplifying the invention has been denoted generally by the reference numeral 10. The toy FIG. 10 comprises a hollow torso 12 composed of a front shell 14 and a rear shell 16. The toy figure also includes a head 18, arms 20 and legs 22.

Figure 4:
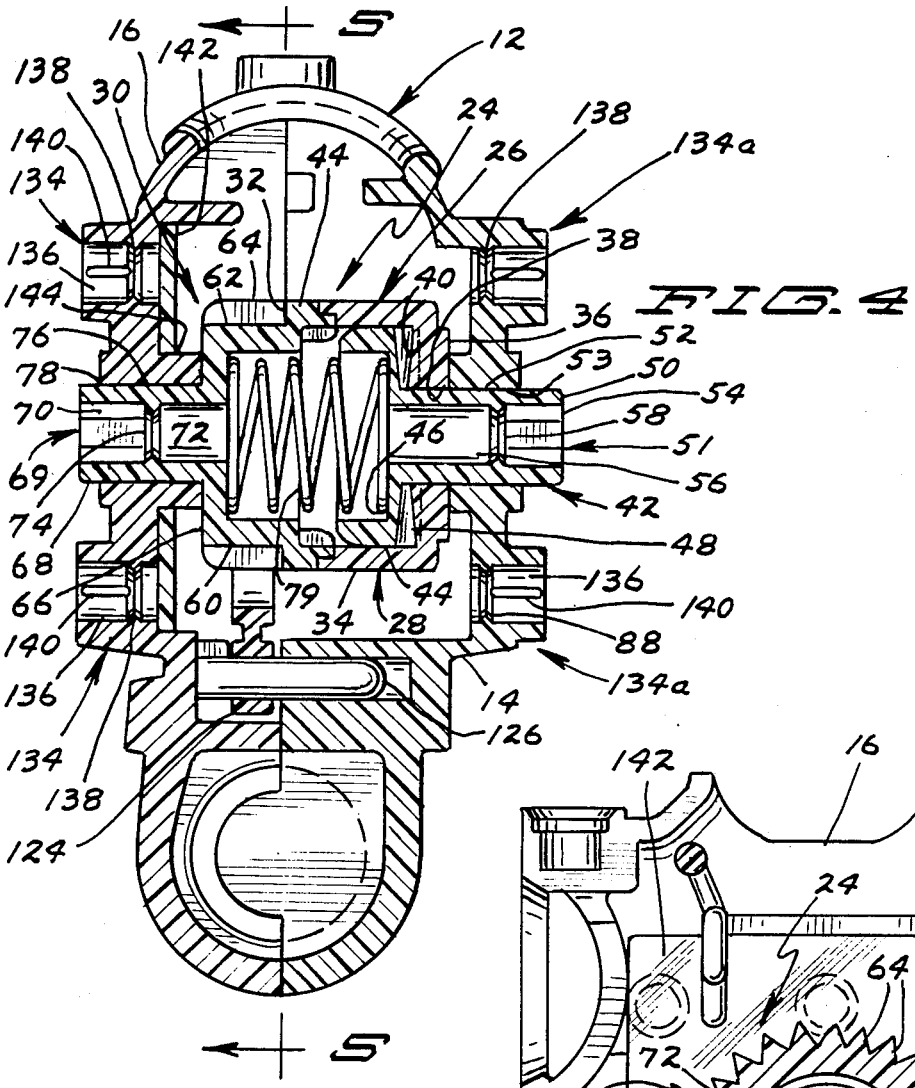
FIG. 4 is a vertical sectional view taken in the direction of line 4—4 of FIG. 1 for the purpose of illustrating a coupling mechanism extending forwardly through the torso, as well as illustrating the configuration of certain receptor holes.

A feature providing an animated movement includes therein a drum-like coupling mechanism 24 comprised of a housing 26 which is formed from forward and rear shells 28 and 30, respectively, which are sealed together at 32 to render the housing 26 unitary. From FIG. 4 it will be perceived that the forward shell 28 includes a cylindrical portion 34, an inturned flange or annular face plate portion 36 having a circular central opening 38. Formed integrally on the inturned flange or annular plate portion 36 is a set of inwardly facing sawteeth or serrations 40, the teeth or serrations 40 being angularly spaced throughout a complete circle on the inner side of the portion 36.

The coupling mechanism 24 additionally includes a driven hub unit 42 having a cup-shaped end residing within the housing 26, more specifically within the shell 28 thereof, and including a relatively large diameter cylindrical portion labeled 44 and an annular inturned flange or annular face plate portion 46, the plate 46 having formed thereon a second set of sawteeth or serrations 48 which are outwardly facing and which are normally urged into engagement with the sawteeth or serrations 40 by means yet to be described. The annular inturned flange or face plate portion 46 has a tubular hub 50 integral therewith, the tubular hub 50 having a cylindrical outer surface at 52 that is journaled in the circular opening 53 provided in the forward shell 14 of the torso 12. The tubular hub 50 is formed with a receptor hole 51 having a hexagonal bore portion 54 extending inwardly from its entrance, that is, from the right toward the left as viewed in FIG. 4. The receptor hole 51 also has an inner cylindrical bore portion 56. Intermediate the bore portions 54, 56 is an internal annular rib 58.

Whereas the hub unit 42 constitutes a driven unit, the rear shell 30 constitutes a driving hub unit in that it includes a first cylindrical portion 60 that is secured, such as with a suitable adhesive, to the cylindrical portion 34 of the shell 28 to make the housing 26 of unitary construction. There is a second cylindrical portion 62 that is stepped inwardly somewhat from the cylindrical portion 60. Formed on the second cylindrical portion 62 is a series of circumferentially extending sawteeth 64, the angularly spaced sawteeth 64 extending completely around the cylindrical portion 62 for a purpose that will become manifest hereinafter.

The rear shell 30 that constitutes a driving hub unit also includes an annular inturned flange or annular plate portion 66 that extends inwardly from the cylindrical portion 62. A tubular hub 68 is integral with the annular plate portion 66, the tubular hub 68 having a receptor hole 69 formed with a bore portion 70 of hexagonal cross section extending inwardly from the bore's entrance. The receptor hole 69 also has a cylindrical inner bore portion 72. Between the two bore portions 70 and 72 is an internal annular rib 74. The tubular hub 68 has a cylindrical outer surface 76 that is journaled for rotation in a circular opening 78 located in the rear shell 16, the opening 78 functionally corresponding to the earlier-mentioned opening 53.

The sawteeth or serrations 48, which are integral with the flange or annular plate portion 46, are normally urged into engagement with the sawteeth or serrations 40, which are integral with the flange or annular face plate portion 36, by means of a somewhat compressed coil spring 79. As can be appreciated from FIGS. 4, the left end of the coil spring 79 reactively bears against the annular portion 66 and the right end bears against the annular portion 46, the coil spring 79 in this way yieldingly biasing the two sets of sawteeth 48 and 40 into engagement. Owing to the sloping sides or inclined working surfaces on the individual teeth 40, 48, it follows that any twisting forces of one set of sawteeth 40 or 48 relative to the other of sufficient magnitude will cause the coil spring 79 to be further compressed, the teeth 40, 48 camming against each other to the extent that the two sets of teeth ride out of the notches between the teeth 40, 48 with the consequence that relative rotation between the units 30 and 42 can readily occur. Thus, the likelihood of any breakage of the parts directly associated with the coupling mechanism 24 is obviated (as well as damage to certain accessories presently to be described).

Figure 6:
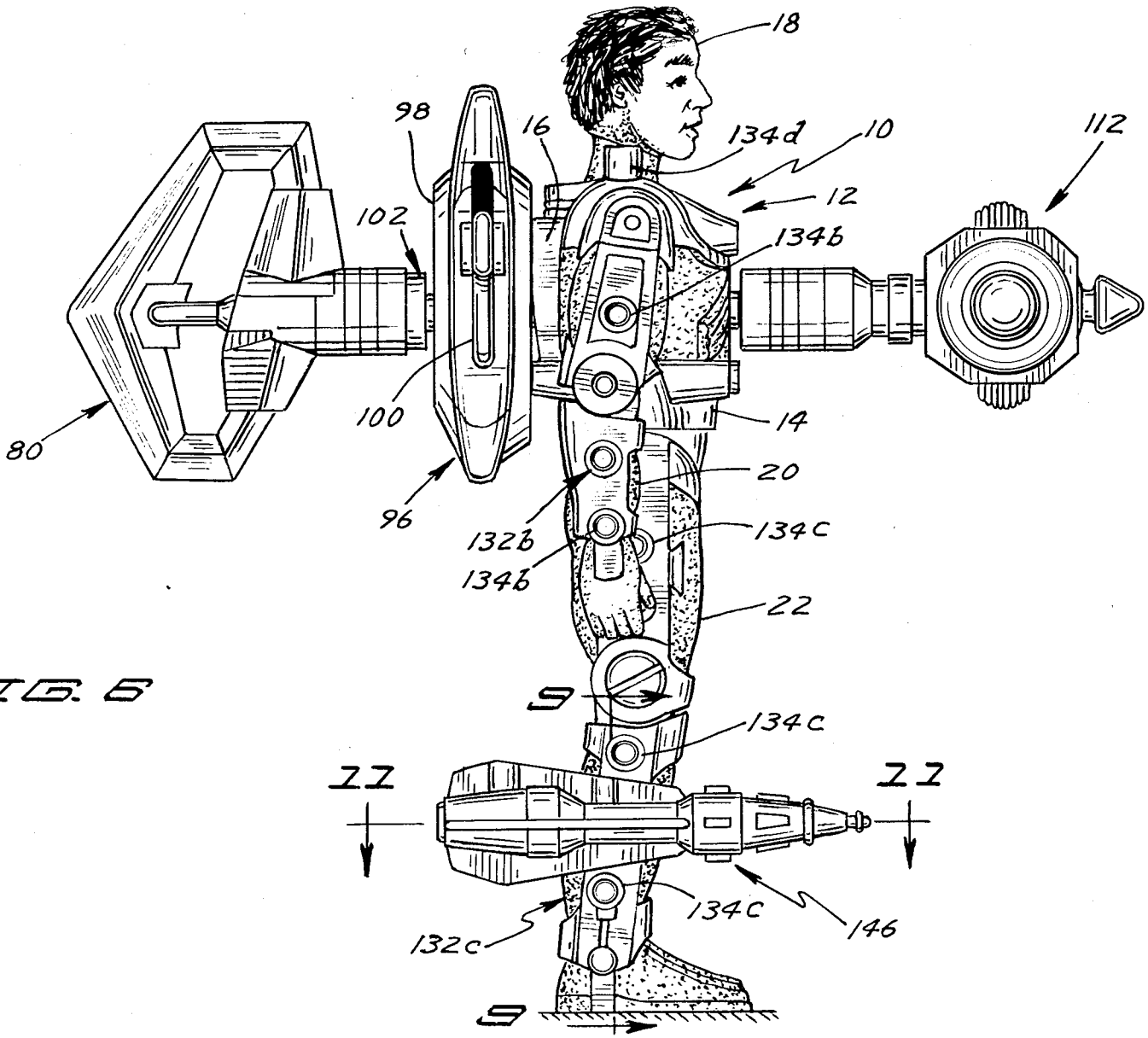
FIG. 6 is a side elevational view corresponding to FIG. 3 but with accessories plugged into the toy figure.
Figures 7, 8:
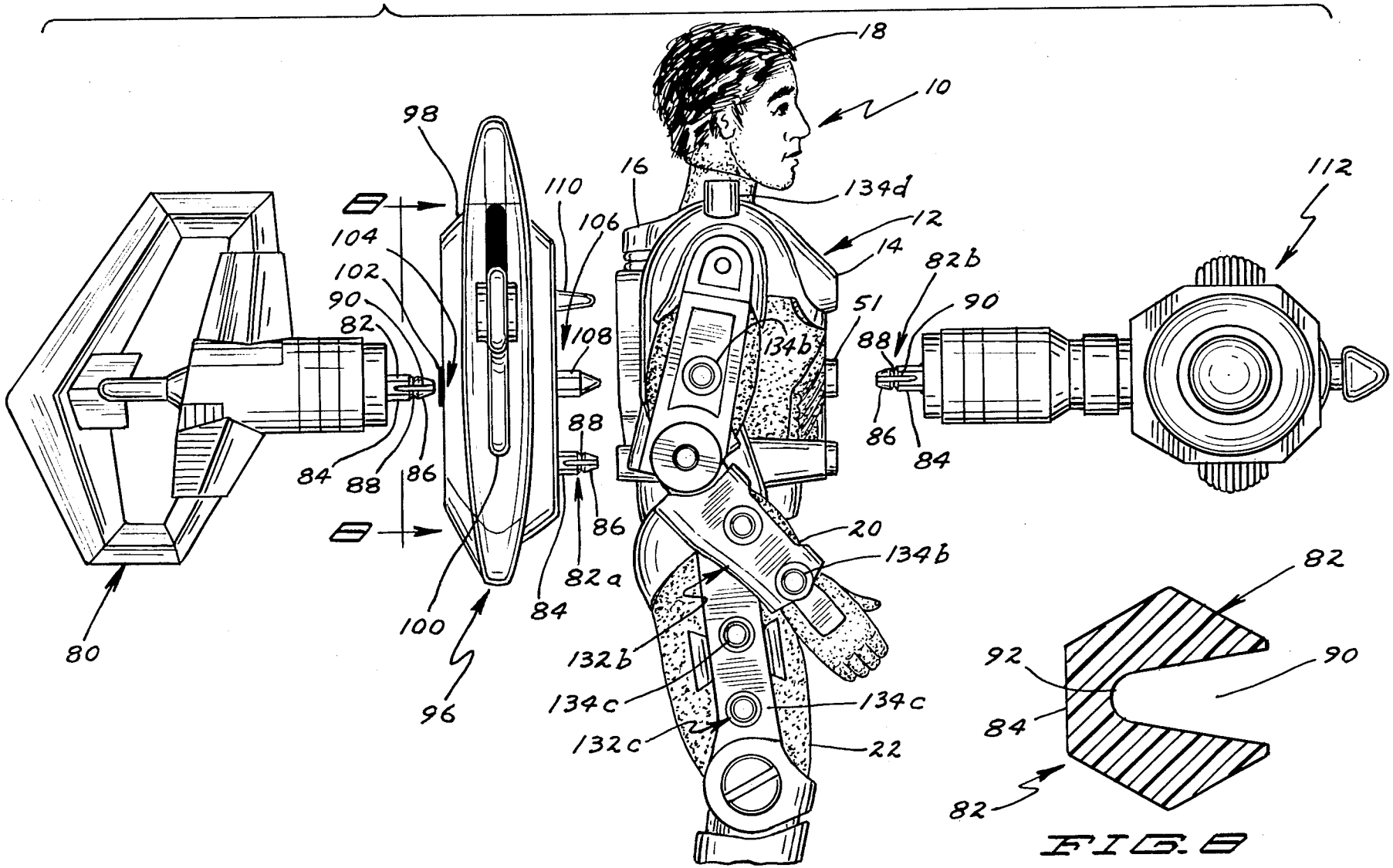
FIG. 7 is a side elevational view corresponding to FIG. 6 but with the accessories shown in an exploded or detached relationship.
FIG. 8 is a greatly enlarged sectional view taken in the direction of line 8—8 of FIG. 7 in order to show the cross sectional makeup of a press-in pin.
Figure 9:
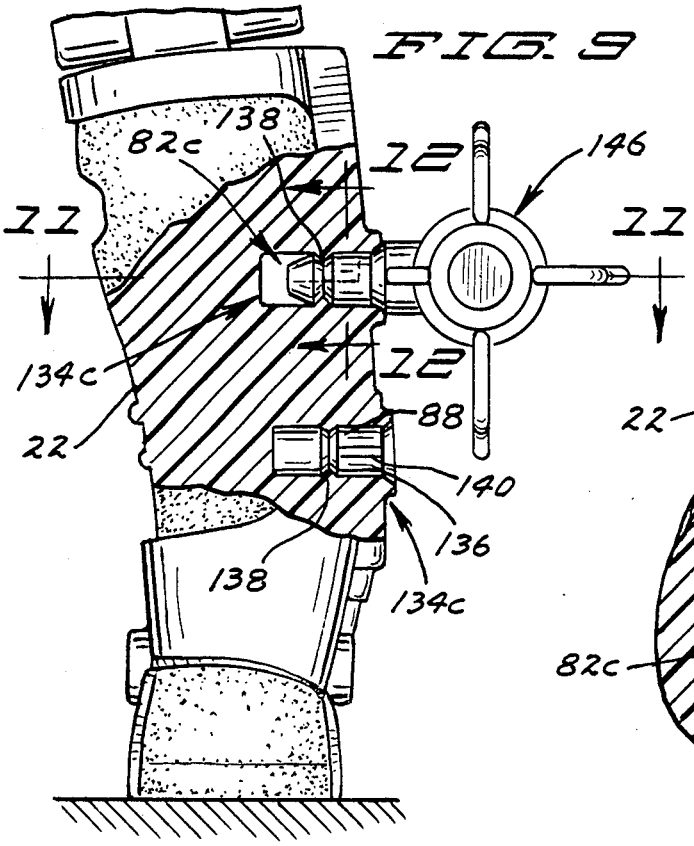
FIG. 9 is a vertical sectional detail taken in the direction of line 9—9 of FIG. 6 in order to show how a press-in pin integrally projecting from a simulated missile launcher is releasably held in a receptor hole, the launcher being viewed from the rear.
Figure 11:
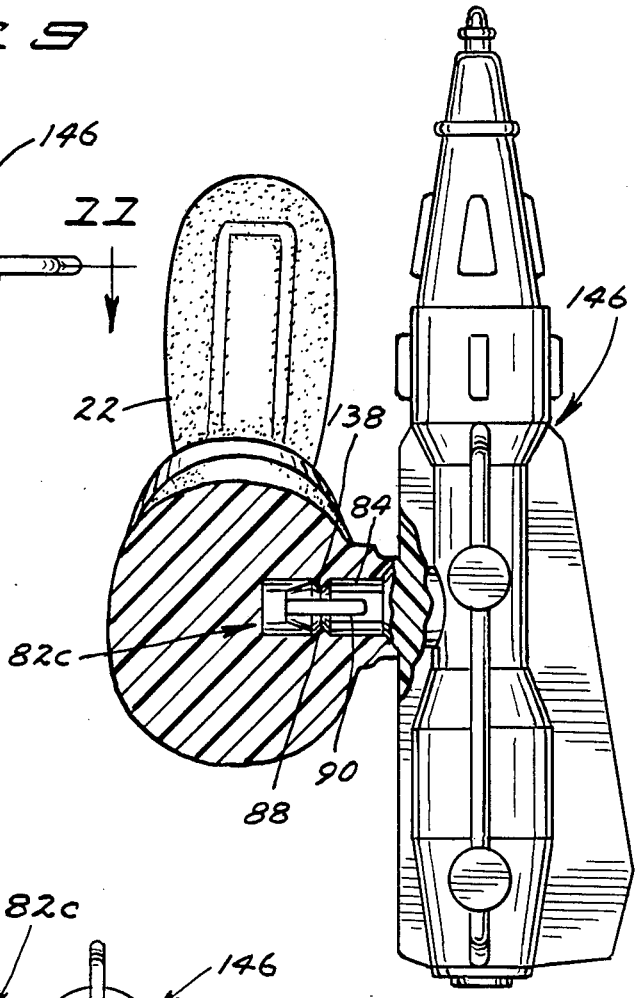
FIG. 11 is a horizontal sectional detail taken in the direction of line 11—11 of FIG. 6.
Figure 12:
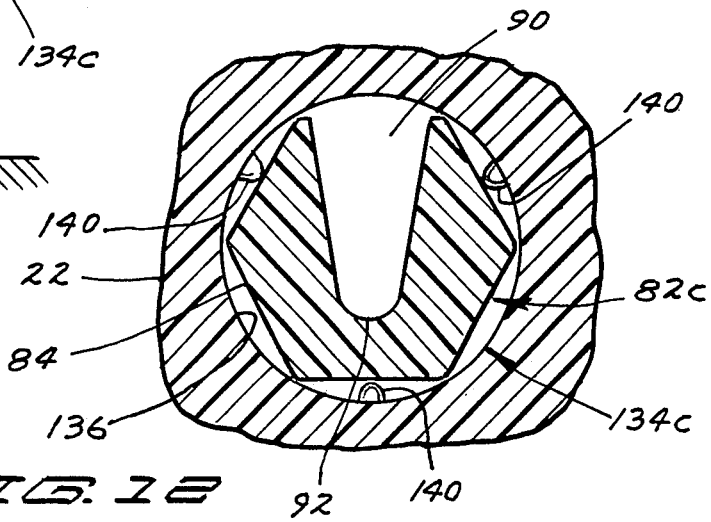
FIG. 12 is an enlarged sectional view taken in the direction of line 12—12 of FIG. 9, the view depicting how the press-in pin is contained within the receptor hole.
Figure 13:
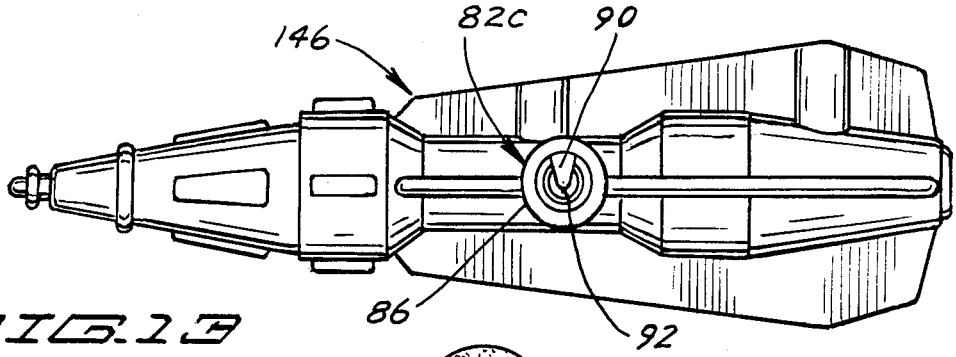
FIG. 13 is a side elevational view of the launcher looking directly at the free end of the press-in pin.

At this time, attention is directed to FIGS. 6 and 7 in which an accessory 80 in the form of a space age rudder serves as a key for twisting or rotating the previously mentioned coupling mechanism 24. The accessory 80 includes a press-in pin 82 that is integral therewith. The press-in pin 82 includes a hexagonal portion 84, a tapered or conical portion 86 and an intermediate circumferential groove 88. Of importance is a longitudinal slot 90 having a bottom or base 92, as best understood from FIG. 8 (and also from FIG. 12 depicting an identical press-in pin **82*c* yet to be referred to). The bottom or base 92, as can also be seen in FIG. 8, has a thickness equal to approximately one quarter of the diameter of the press-in pin 82; in other words the slot 90 has a depth equal to approximately three fourths of the diameter of the pin 82. Still further, it should be noted that the slot 90 is formed with diverging sidewalls which can be flexed toward each other to narrow the slot 90** in a manner that will become evident hereinafter.

More will be said later on concerning the type of material that the press-in pin 82 is fabricated from, but at this stage it should be recognized that the longitudinal slot 90 renders the pin sufficiently compliant so that it can be easily inserted and withdrawn from any one of a number of selected receptor holes, including the two already identified by the reference numerals 51 and 69, plus those yet to be referred to. As the description progresses, it will be understood that the slot 90 imparts a sufficient amount of compliancy to the press-in pin 82 so that it will be retained in place once inserted into any one of a number of receptor holes that might be selected. As already explained, only the receptor holes 51 and 69 have been referred to up to this point.

At this time, attention is called to a winged accessory 96 comprised of a hollow housing 98 and a pair of pivotal wings 100, there being one wing 100 visible in FIG. 7 (the other wing being on the far side of the housing 98 and thus concealed from view). It is not believed necessary to describe the internal coupling mechanism contained in the housing 98, for it does not constitute a part of the invention. However, the mechanism has been indicated generally by the numeral 102, including a drive hub 104 that is like the previously mentioned tubular hubs 50 and 68 in that it includes a hexagonal bore portion (not shown) into which the hexagonal portion 84 of the press-in pin 82 is received. Also, the hub 104 has therein an internal rib (not shown) corresponding to the previously mentioned ribs 58 and 74. The coupling mechanism 102 additionally includes a driven pin 106 that projects from the housing 98, having a hexagonal portion 108 that provides a longitudinal slip fit when inserted into the hexagonal bore portion 70 of the tubular hub 68 belonging to the coupling mechanism 24 that extends forwardly through the torso 12. The interfitting hexagonal portion 108 within the hexagonal portion 70 prevents any relative rotation between the pin 106 and the tubular hub 68. Owing to the hexagonal portion 84 on the press-in pin 82 and the complementally configured hexagonal bore portion (not illustrated) formed in the drive hub 104 of the coupling mechanism 102, relative rotation is precluded between the pin 82 and the coupling mechanism 102.

In addition to the pin 106 that projects from the housing 98 of the winged accessory 96, there are two press-in pins **82*a* which are very similar to the previously mentioned press-in pin 82, the only difference being that the pins 82*a* are not molded to the accessory 96; instead, the pins 82*a* are attached to the housing 98 in a grommet-like manner, there being a circumferential groove (not visible) in each pin 82*a* into which the circular edges, forming holes (also not shown) in the housing 98, fit. The mounting of the pins 82*a* though the agency of the grooves and circular edges in the manner only generally referred to is to facilitate the molding of the housing 98; whether the pin 82 or pins 82*a* are integral with the accessory or separately attached depends upon the configuration of the particular accessory. Only one of the pins 82*a* is visible in FIG. 7 it can be pointed out. The reason only one pin 82*a* is visible in FIG. 7 is that the other one is located on a diagonal line extending from the visible pin 82*a* through the driven pin 106 to a location concealed by one of two guide pins 110. The other guide pin 110 is concealed by the visible press-in pin 82*a*. In other words, the two guide pins 110 are arranged on another diagonal line which includes the visible guide pin 110, and the driven pin 106 plus the obscured guide pin 110. The guide pins 110 are both of relatively simple configuration in that they do not perform any retention function as do the press-in pins 82*a*. Thus, there are five pins (the pin 106, the two pins 82*a* and the two pins 110) projecting from the winged accessory 96. However, the overall roles played by these pins 106, 82*a* and 110 will perhaps be better appreciated when a specific hole pattern is hereinafter referred to that is provided in the rear torso shell 16**.

At this time, attention is called to a make-believe sensing accessory 112 that has a press-in pin **82*b* that is identical to the previously mentioned press-in pins 82 and 82*a*. The press-in pin 82*b* is releasably retained within the receptor hole 69 in the tubular hub 68 of the coupling mechanism 24**.

From the description given up to this point, it should be evident that the rudder accessory 80, owing to the hexagonal portion 84 on its press-in pin 82, when twisted, produces a rotative movement of the coupling mechanism 102 because the hexagonal portion 84 fits within the hexagonal bore portion (not shown) contained in the hub 104 belonging to the coupling mechanism 102. The rotary motion of the coupling mechanism 102, which is contained in the winged accessory 96, causes the coupling mechanism 24 to rotate due to the interfitting of the hexagonal portion 108 of the pin 106 within the hexagonal bore portion 70 of the hub 68. It will be appreciated, of course, that the press-in pin 82 on the rudder accessory 80, could, if desired, be inserted directly into the receptor hole 69 belonging to the tubular hub 68 of the coupling mechanism 24, or if the child chooses to do so, the press-in pin 82 on the rudder accessory 80 could be plugged into the receptor hole 51 instead of the press-in pin **82*b* of the sensing accessory 112**, as has been depicted. As a matter of fact, it is within the contemplation of the invention to make use of a number of accessories and the accessories that will herein be referred to are only to be considered illustrative of the overall number that could be used and certain of which can be substituted for others.

At any rate, the rotation of the coupling mechanism 24 is instrumental in rotating the sensing accessory 112 in that the press-in pin **82*b* thereon is rotated by reason of the receptor hole 69 provided at the other end of the coupling mechanism 24. Here again, other accessories than the sensing accessory 112 can be inserted into the receptor hole 69, such as the accessory 80** as mentioned above, all in accordance with what specific accessories are provided by the manufacturer and also depending upon the selection thereof by the individual child. For example, accessories with several pins can be provided so that different physical orientations can be achieved.

Figure 10:
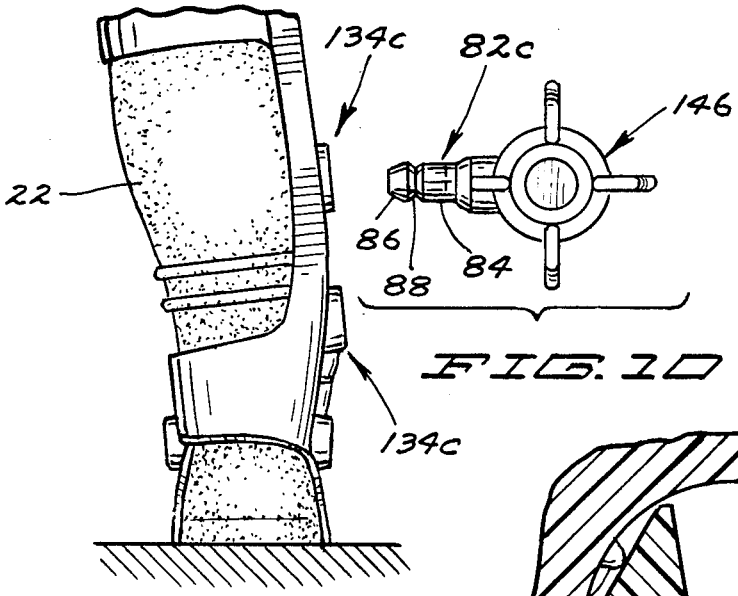
FIG. 10 is an exploded view corresponding to FIG. 9, the view being on a slightly reduced scale.

Lending a degree of audible intrigue to the toy FIG. 10 is a click-type sound producing device indicated generally by the reference numeral 116. From FIG. 5, it will be discerned that the click producing device 116 includes a wishbone-shaped, pawl-type element 118. The element 118 comprises a semicircular or arcuate arm 120 having a resilient portion **120*a* provided with a tooth 121 at its free end, and the element 118 also comprises a portion 120*b* rendered rigid by means of an integral web 122 extending along its underside. Integral with the web 122 is a horizontal tubular bearing 124 that encircles a forwardly extending pin 126. More specifically, the pin 126 is integral with the rear torso shell 16. The rigid portion 120*b* is formed at its left end with a semicircular notch 128 that engages a second pin 130 that also projects forwardly from the rear shell 16. The click-producing device 116 can also be considered to include the previously mentioned circumferential sawteeth 64**.

Figure 5:
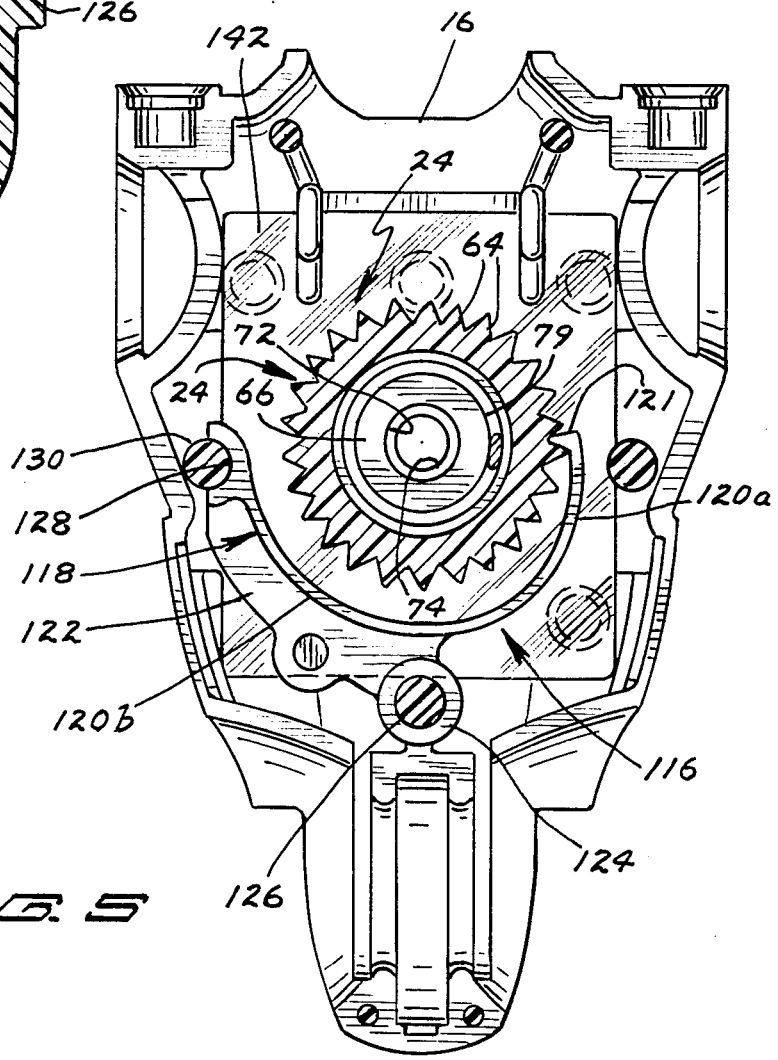
FIG. 5 is a vertical sectional view taken in the direction of line 5—5 of FIG. 4 for the purpose of further illustrating the construction of the coupling mechanism, the view also depicting a U-shaped pawl-type element for producing a clicking sound when the coupling mechanism is rotated and the view additionally showing a rearwardly disposed light shield that prevents light from passing through the torso via the various receptor holes located in the front and rear portions of the torso.

Consequently, as the coupling mechanism 24 is rotated, such as in the manner previously described, the tooth 121 at the end of the resilient portion **120*a* rides in and out against the sawteeth 64, being flexed outwardly to the right as viewed in FIG. 5 and then, when one of the teeth 64 passes the tooth 121, the tooth 121 springs back into the position appearing in FIG. 5. It is this repeated flexing of the pawl-type element 118 that produces the clicking sound, enhancing the animated action of whatever accessories are releasably plugged into the receptor holes 51 and 69 in the ends of the coupling mechanism 24. The clicking, it will be appreciated, can be achieved in either rotational direction of the mechanism 24**.

The configuration of the two receptor holes 51 and 69 has already been described. However, the invention utilizes a relatively large number of receptor holes. Therefore, reference should now be made to FIG. 2 in which a pattern of receptor holes has been indicated generally by the reference numeral 132. The pattern 132 includes six individual holes clustered or grouped in a predetermined relation with respect to the receptor hole 69. It will be well to identify the various receptor holes included in the pattern 132; accordingly, the reference numeral 134 has been selected. While all of the receptor holes 134 appear in FIG. 2, it will be observed that two of the receptor holes 134 appear in FIG. 4, one being just above the receptor hole 69 and the other being just below the receptor hole 69. The receptor holes 134, while identical to each other, differ from the receptor hole 69 (and also from the receptor hole 51). Specifically, each receptor hole 134 includes a cylindrical bore portion 136 extending inwardly to an annular rib 138. As perhaps best understood from FIG. 12, the cylindrical bore portion 136 of each receptor hole has three angularly spaced ribs 140 extending longitudinally along the bore portion 136. Inasmuch as the receptor hole appearing in FIG. 12 is contained in a hole pattern yet to be referred to, it carries the reference numeral **134*c*. The configuration of the two holes 134 and 134*c*, however, (as well as other receptor holes in the shell 14 and arms 20**) are identical.

When a press-in pin **82*a* (or 82) is inserted into any one of the individual receptor holes 134, the compliancy of the press-in pin derived largely from its slot 90, enables the circumferential groove 88 thereon to engage the annular rib 138 recessed within the particular receptor hole 134. Thus, a snap-in retention is immediately produced by reason of the groove and rib engagement. The longitudinal ribs 140, of course, guide the press-in pin 82*a* into the particular receptor hole 134. As already indicated, each receptor hole 134 is like the one appearing in FIG. 12**.

From FIG. 2, it should be evident that only four of the receptor holes 134 are utilized when mounting the winged accessory 96. More specifically, it is the upper left receptor hole 134 of the pattern 132 that receives therein one of the press-in pins **82*a*, this being the one that is concealed by the guide pin 110 in FIG. 7. Also, the receptor hole 134 at the upper right in FIG. 2 of the pattern 132 is made use of, the guide pin 110 extending thereinto. Similarly, the lower left receptor hole 134 receives the guide pin 110 that is concealed by the press-in pin 82*a* that is lowermost in FIG. 7, whereas the visible press-in pin 82*a* seen in FIG. 7 is received in the lower right receptor hole 134 of the pattern 132. It is the receptor holes 134 immediately above and immediately below the receptor hole 69 that are not made use of as far as the accessory 96 is concerned. Of course, the receptor holes 134 immediately above and immediately beneath the receptor hole 69 are available for use depending upon the specific pin pattern or formation on the particular accessory to be attached to the back of the torso 12**.

Whereas the pattern 132 composed of the individual receptor holes 134 is in the rear shell 16 of the torso 12, an identical pattern **132*a* is provided in the front shell 14, being comprised of individual receptor holes 134*a*. These receptor holes are identical to the receptor holes 134, having a cylindrical bore portion 136, an annular rib 138 and longitudinal ribs 140. In the illustrated instance, the sensing accessory 112 is to be rotated about its own longitudinal axis by the coupling mechanism 24. Therefore, no need exists for any additional pins, even though the holes 134*a* in the pattern 132*a* are available for selection when a different type of accessory is to be releasably attached. Thus, it will be appreciated that an accessory corresponding generally to, say, the winged accessory 96 could be employed at the front of the torso 12 instead of the accessory 112**.

Inasmuch as the two patterns 132 and **132*a* containing the receptor holes 134 and 134*a*, respectively, are aligned with each other, light will pass through any of the holes 134 or 134*a* that do not have a press-in plug 82 or 82*a* inserted therein. Therefore, an opaque plastic shield 142 is shaped to fit within the confines of the rear torso shell 14. From FIG. 4 it can be seen that the shield 142 has an opening 144 therein so as to encircle the tubular portion of the rear shell 16 that provides the circular opening 78 in which the tubular hub 68** is journaled.

Not only are receptor holes provided in both of the shells 14 and 16 of the hollow torso 12, but additional receptor holes are formed in the limbs of the toy action FIG. 10. In this regard, it will be discerned that there is a three-hole pattern 132b in the right arm 20 that is visible in FIG. 3. In this instance, the hole pattern 132b includes a single hole 134b in the upper arm member and two holes 134b in the forearm member of the right arm 20. Although not visible, a duplicate pattern 132b is provided in the left arm 20.

As far as the legs 22 are concerned, each leg 22 contains therein an additional hole pattern 132c, the hole pattern 132c including five individual receptor holes 134c. In this instance, two of the holes 134c are located above the knee joint and three below the knee joint, as can perhaps be best understood from FIGS. 1 and 2, although generally understandable from FIGS. 3 and 6, too. Once again, it will be mentioned that the details of the hole 134c were earlier-described when referring to the hole 134; the two holes 134 and 134c, as well as the holes 134a and 134b, are of identical construction.

To illustrate the versatility of the invention, a simulated missile launcher 146 is shown releasably attached to one of the receptor holes 134c contained in the pattern 132c located in the right leg 22. Projecting from one side of the missile launcher 146 is a press-in pin 82c that is identical to the press-in pin 82. In this instance, however, the slot 90 is uppermost to facilitate molding and this is the only difference. This difference is pictorially understandable from FIG. 8 (and also FIG. 12) which has already been referred to for the purpose of describing the construction of the press-in pin 82. FIG. 12 is beneficial, however, in showing how the hexagonal portion 84 is received in the particular receptor hole 134c. In this regard, it will be observed from FIG. 12 that three of the flats on the hexagonal portion 84 are oriented so as to be in general angular registry with the three ribs 140 appearing in 84. The ribs 140 not only guide the hexagonal portion 84 into the receptor hole 134c, but enable the press-in pin 82c to be deliberately rotated within the receptor hole 134c, the ribs 140 resisting rotation by virtue of the fact that the portions of the pin flanking the slot 90 have to be flexed inwardly by one or two of the several ribs 140 in order for the pin 82c to be rotated. Thus, the pin 82c resists rotation, as it should where a particular accessory, such as the simulated missile launcher 146, is to be maintained at a particular angular position or attitude relative to the particular member (the right leg 22 in this instance) into which it has been plugged. Stated somewhat differently, the missile launcher 146 is intended to be aimed forwardly as far as its particular position on the right leg 22 is concerned. However, it is contemplated that other types of accessories might very well be plugged into one or more of the receptor holes 134c in the legs 22, or one or more of the receptor holes 134b in the arms 20, or one or more of the receptor holes 134a in the front shell 14, or one or more of the receptor holes 134 in the rear shell 12, or for that matter in one of the two receptor holes 134d facing upwardly from the shoulders of the torso 12.

Even the feet at the lower ends of the legs 22 can be provided with receptor holes, although such holes have not been shown in the drawings. Thus, the exemplary toy action FIG. 10 is susceptible to having a variety of accessories plugged into it by means of various press-in pins. Not only do the hole patterns formed in the various portions of the toy action FIG. 10 present a unique and attractive appearance, but they provide a utilitarian function in that they enable a number of differently designed accessories to be added onto the toy FIG. 10. As herein earlier pointed out, the type of receptor hole and the type of press-in pin enable a force fit to be effected that is not so great that it inhibits the insertion of any given press-in pin by a relatively small child and by the same token enables the child to retract the pin when he or she wishes. It should be distinctly noted that the several stylized accessories herein described are only exemplary and that various others can be added or substituted for those that have been pictured, depending on what accessories are being marketed.

Although the materials used for the toy action FIG. 10 and the various accessories are susceptible to some choice, high impact polystyrene (or acetal) plastic has been found suitable for the torso 12, whereas the various press-in pins are preferably of a softer material, such as polyvinyl chloride (which can also be used for the arms 20 and legs 22). The structure of each press-in pin 82, 82a, 82b and 82c is such that it is sufficiently compliant so as to not unduly resist insertion and not to unduly resist withdrawal from any of the receptor holes. By having the slot 90 not go all the way through the thickness or diameter of the various press-in pins, a sufficient amount of resiliency is imparted to each press-in pin 82, 82a, 82b and 82c so that the slot 90 thereof can be somewhat narrowed, owing to the inward flexing of its side walls and also flexing of the base 92 itself when inserted into a given receptor hole 134, 134a, 134b or 134c. Of course, it is the receptive or nestive engagement of a given circumferential groove 88 with an annular rib 138 that releasably retains the particular press-in pin within its particularly selected receptor hole 134, 134a, 134b or 134c. The interfitting hexagonal portions 54 and 84 (and 70 and 84) provide a reliable means for transmitting rotative motion from one accessory to another, such as to and from the coupling mechanism 24 via the receptor holes 51 and 69. On the other hand, as already explained, the presence of the longitudinal ribs 140 in the receptor holes 134, 134a, 134b, 134c and 134d resist twisting of the particular press-in pin 82, 82a, 82b and 82c therein but permiting rotation or twisting to occur when desired because the slot 90 permits a flexing in or narrowing of the pin so that the flats on the hexagonal portion 84 in each instance can rotate past the several ribs 140 provided in a particular receptor hole 134, 134a, 134b, 134c or 134d, as the case may be.

From the foregoing, it should be apparent that any of the slotted press-in pins can be readily inserted and withdrawn from any of the receptor holes.

Figure 14:
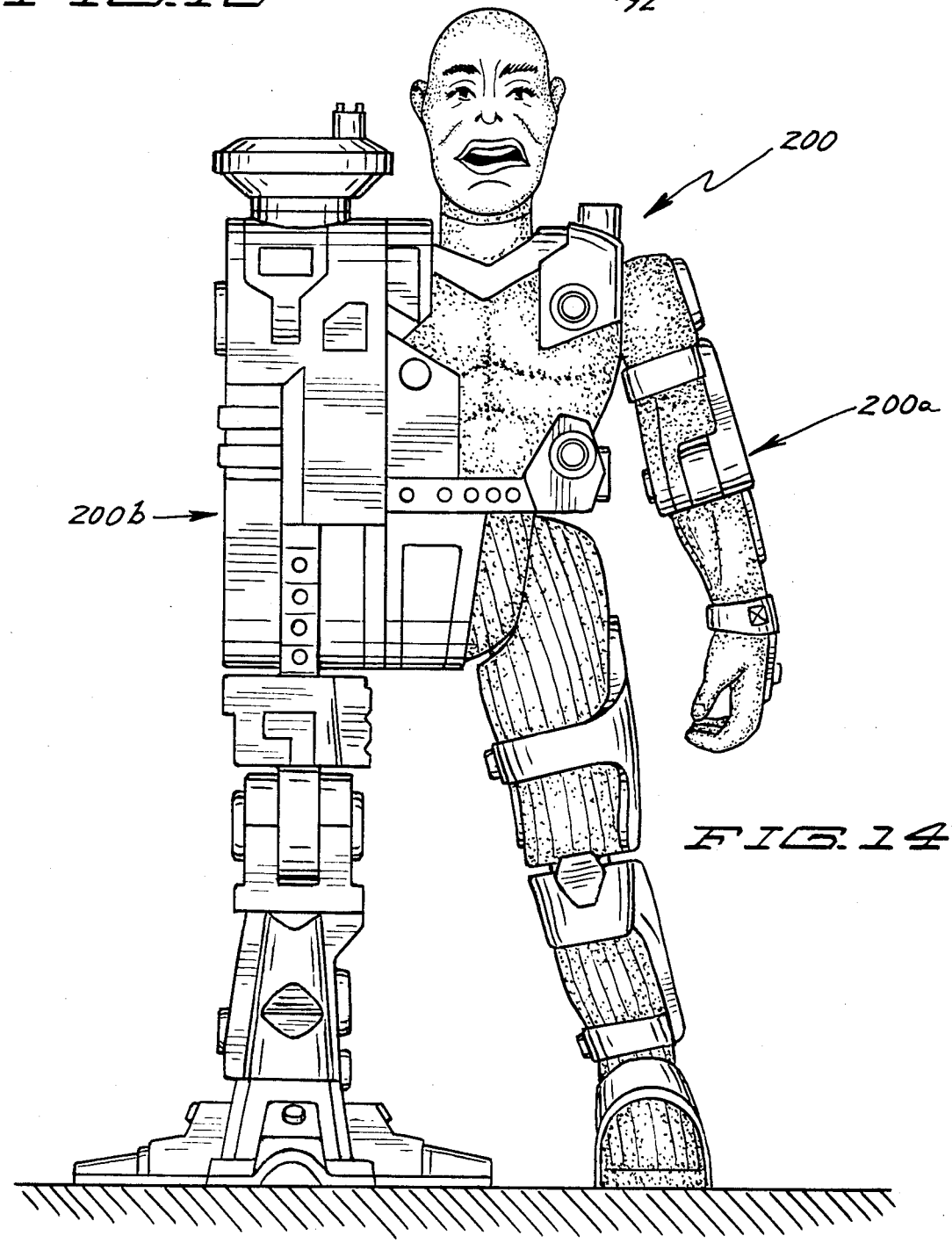
FIG. 14 is a front elevational view of a composite toy action figure in the form of a combined man and machine.
Figure 15:
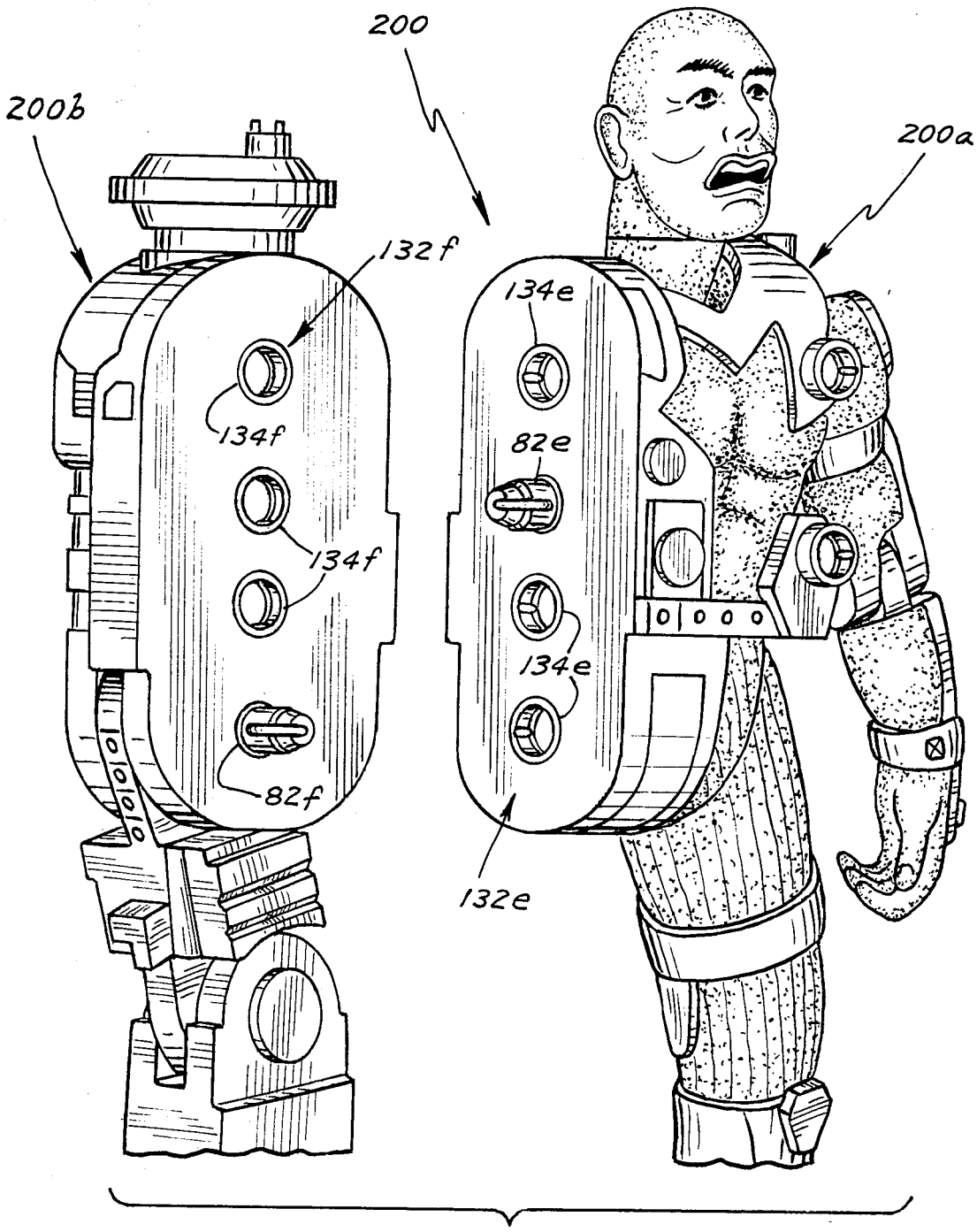
FIG. 15 is an open face exploded view of the composite man and machine of FIG. 14.

Specific attention is now directed to FIGS. 14 and 15 wherein a composite toy action FIG. 200 is illustrated. One half or part 200a is in the form of a human being and the other half or part 200b is in the form of a machine. Projecting from the part 200a is a press-in pin 82e which is identical to the press-in pin 82 (and also to the pins 82a, 82b and 82c), and projecting from the part 200b is another press-in pin 82f which is likewise identical to the press-in pin 82 (and also to the pins 82a, 82b, 82c and 82e). Even though constituting a straight line pattern, the part 200a is provided with a pattern 132e of receptor holes 134e; the receptor holes 134e are individually identical to the receptor holes 134, 134a, 134b, 134c and 134d. Similarly a straight line pattern 132f of receptor holes 134f is formed in the part 200b; the receptor holes 134f are likewise identical to the holes 134, 134a, 134b, 134c, 134d and 134e. What is important is that the press-in pins 82e and 82f be physically oriented with the receptor holes 134f and 134e, respectively, so as to be insertable therein when the two parts shown separated in FIG. 15 are assembled or releasably attached as pictured in FIG. 14. Of course, various accessories having one or more press-in pins can be releasably attached to either part 200*a* or 200*b*.

Hence, the composite toy action FIG. 200 further illustrates the versatility of the invention.

What is claimed:

1. In combination, a toy action figure comprising a hollow torso having a first plurality of receptor holes in the front thereof and having a second plurality of receptor holes in the rear thereof, at least some of said first receptor holes being arranged in a first predetermined pattern and at least some of said second receptor holes being arranged in a second predetermined pattern, a rotatable coupling mechanism extending through said torso, one of said first receptor holes being in one end of said coupling mechanism and one of said second receptor holes being in the other end of said coupling mechanism, an accessory comprising a projecting press-in pin for insertion into a selected one of said receptor holes, and coacting means in said receptor holes and on said press-in for releasably retaining said press-in pin within the selected one of said receptor holes.

2. The combination of claim 1 in which the first receptor holes of said first pattern are arranged in a predetermined relationship with respect to said one receptor hole in said one end of the coupling mechanism and in which the second receptor holes of said second pattern are arranged in a predetermined relationship with respect to said one receptor hole in said other end of the coupling mechanism.

3. The combination of claim 2 in which said patterns are identical and in which the respective relationships of said patterns with respect to the receptor holes in said coupling mechanism are also identical.

4. The combination of claim 3 including a light shield within said torso for preventing any perceptible amount of light from passing through any of the receptor holes of said patterns in which said press-in pin has not been inserted.

5. The combination of claim 1 in which said toy action figure includes a pair of arms and a pair of legs, said arms and legs each having at least one receptor hole therein.

6. The combination of claim 1 in which said retaining means includes an annular groove extending around said press-in pin and an annular rib recessed in each of said receptor holes engageable in said annular groove.

7. The combination of claim 6 in which said press-in pin has a tapering portion extending from said annular groove to the free end of said pin.

8. The combination of claim 7 in which said pin has a longitudinal slot extending partially therethrough.

9. The oombination of claim 8 in which said pin has a noncircular portion extending from said annular groove in a direction opposite to the direction said tapered portion extends.

10. A toy action figure comprising a hollow torso having a plurality of receptor holes therein arranged in a predetermined pattern for the accommodation of a press-in pin in at least a selected one of said receptor holes, said press-in pin projecting from an accessory to be releasably attached to the hollow torso, and a rotatable coupling mechanism extending through said torso, one end of said coupling mechanism being in a predetermined relation with respect to at least some of said receptor holes, said torso including front and rear shells, said pattern of receptor holes being in said front shell, said front and rear shells each having an opening, said openings being axially aligned and said coupling mechanism extending therebetween, said rear shell having a second plurality of receptor holes therein arranged in a predetermined pattern for the accommodation of a second receptor press-in pin in at least a selected one of said second holes, said second press-in pin projecting from a second accessory to be releasably attached to said torso and said coupling mechanism having its other end in a predetermined relation with at least some of said second holes.

11. The toy action figure of claim 10 in which the plurality of receptor holes in said front shell includes a group of receptor holes and the opening in said front shell is spaced a predetermined distance from each of said receptor holes contained in said group of holes, and the plurality of receptor holes in said rear shell includes a second group of receptor holes, the opening in said rear shell being spaced a predetermined distance from each of said receptor holes contained in said second group of holes.

12. A toy action figure comprising a hollow torso having a plurality of receptor holes therein arranged in a predetermined pattern for the accommodation of a press-in pin in at least a selected one of said receptor holes, said press-in pin projecting from an accessory to be releasably attached to the hollow torso, and a rotatable coupling mechanism extending through said torso, one end of said coupling mechanism being in a predetermined relation with respect to at least some of said receptor holes, said torso including front and rear shells, said pattern of receptor holes being in said front shell, said front and rear shells each having an opening, said openings being axially aligned and said coupling mechanism extending therebetween, said coupling mechanism including a pair of hub members projecting in opposite directions, said hub members being journaled for rotation in said openings, a first set of teeth or serrations fixedly associated with one of said hub members and a second set of teeth or serrations fixedly associated with the other of said hub members, and resilient means urging said first set of teeth or serrations into engagement with said second set of teeth or serrations so that said other hub member is rotated in unison with said one hub member.

13. The toy action figure of claim 12 in which said hub members are each provided with a receptor hole having a hexagonal bore portion and an annular rib recessed within each of said hub members at the inner end of its hexagonal bore portion.

* * * * *